US006334533B1

(12) United States Patent
Hollingsworth et al.

(10) Patent No.: US 6,334,533 B1
(45) Date of Patent: Jan. 1, 2002

(54) ADJUSTABLE IMPACT RESISTANT CUSHION FOR CARRYING CASE

(75) Inventors: W. Dale Hollingsworth, Wilton; Charles S. O'Connor, Westport, both of CT (US)

(73) Assignee: Targus Group International, New York, NY (US)

( * ) Notice: Subject to any disclaimer, the term of this patent is extended or adjusted under 35 U.S.C. 154(b) by 0 days.

(21) Appl. No.: 09/679,599

(22) Filed: Oct. 5, 2000

Related U.S. Application Data

(62) Division of application No. 09/235,292, filed on Jan. 22, 1999, now Pat. No. 6,131,734.
(60) Provisional application No. 60/072,296, filed on Jan. 23, 1998.

(51) Int. Cl.[7] ..... B65D 85/30
(52) U.S. Cl. ..... 206/320; 206/523; 190/107
(58) Field of Search ..... 206/305, 320, 206/523, 576, 591, 592, 594; 150/106, 107; 119/103–105, 107, 109, 119

(56) References Cited

U.S. PATENT DOCUMENTS

| | | | |
|---|---|---|---|
| 3,412,521 | A | 11/1968 | Bauman |
| 3,949,879 | A | 4/1976 | Peterson et al. |
| 4,339,039 | A | 7/1982 | Mykelby |
| 4,569,082 | A | 2/1986 | Ainsworth et al. |
| 4,573,202 | A | 2/1986 | Lee |
| 4,620,633 | A | 11/1986 | Lookholder |
| 4,854,732 | A | 8/1989 | Italici |
| 4,874,093 | A | 10/1989 | Pharo |
| 5,010,988 | A | 4/1991 | Brown |
| 5,129,519 | A | 7/1992 | David et al. |
| 5,217,119 | A | 6/1993 | Hollingsworth |
| 5,402,892 | A | 4/1995 | Jaszai |
| 5,494,157 | A | 2/1996 | Golenz et al. |
| 5,524,754 | A | 6/1996 | Hollingsworth |
| 5,607,054 | A | 3/1997 | Hollingsworth |
| 5,622,262 | A | 4/1997 | Sadow |

(List continued on next page.)

FOREIGN PATENT DOCUMENTS

| | | |
|---|---|---|
| EP | 0 797 939 A2 | 1/1997 |
| EP | 0 797 939 A3 | 1/1998 |

*Primary Examiner*—Luan K. Bui

(57) ABSTRACT

An adjustable, impact resistant cushion for use in a carrying case or the like has a first pad including a compressible, substantially rectangular foam piece covered with a pliable non-porous cover. The cover continuously covers the foam piece and includes an air flow controlling vent. Air escapes from the pad through the vent at a controlled rate when the foam material is compressed and so the pad absorbs shock by providing resistance to compression which increases with increasing compression velocity. Preferably, open cell urethane foam is employed in the compressible foam piece. The adjustable impact resistant cushion includes a second pad hingedly connected by a flexible hinge segment of webbing or plastic. The adjustable cushion includes, on a back surface, one or more releasable hook and loop type fasteners elements (e.g., either hooks or loops). Preferably, two of the impact resistant cushions are used in a luggage insert (for insertion into a carrying case or other luggage) or are incorporated directly into the interior portion of a carrying case having compartment with an interior surface covered with felt or loop material for attachment using hook fasteners carried by the adjustable cushions. An adjustable cushion may also carry one or more flexible tabs extending outwardly from the cushion pad major axis and so can be positioned in cushion pairs at selected separations and angular orientations, thereby accommodating portable computers having different widths.

19 Claims, 9 Drawing Sheets

U.S. PATENT DOCUMENTS 5,624,035 A 4/1997 Kim
5,676,509 A 10/1997 Enzu
5,755,329 A 5/1998 Sadow
5,765,688 A 6/1998 Bertram et al.
5,769,231 A 6/1998 Batsford
5,769,232 A 6/1998 Cash et al.
5,775,497 A * 7/1998 Krulik ..... 206/320
5,808,865 A 9/1998 Alves
5,819,942 A * 10/1998 Sadow ..... 206/523
5,857,568 A * 1/1999 Speirs ..... 206/320
5,887,723 A * 3/1999 Myles et al. ..... 206/320
5,909,806 A 6/1999 Fischel et al.
5,960,952 A * 10/1999 Chen ..... 206/320
6,073,770 A * 6/2000 Park ..... 206/320
6,105,766 A * 8/2000 Chuang ..... 206/320
6,109,434 A 8/2000 Howard, Jr.
6,131,734 A 10/2000 Hollingsworth
6,145,661 A 11/2000 Jung
6,213,266 B1 4/2001 Hollingsworth
6,237,766 B1 5/2001 Hollingsworth

* cited by examiner

ADJUSTABLE IMPACT RESISTANT CUSHION FOR CARRYING CASE

CROSS REFERENCE TO RELATED APPLICATIONS

This application is a divisional application of pending U.S. patent application Ser. No. 09/235,292 filed Jan. 22, 1999, U.S. Pat. No. 6,131,734 which claims benefit of provisional application Serial No. 60/072,296 filed Jan. 23, 1998, the disclosures of which are incorporated herein by reference.

BACKGROUND OF THE INVENTION

1. Field of the Invention

The present invention relates generally to impact resistant cushions adapted for use in carrying cases and to carrying cases for securely transporting delicate instruments such as portable computers.

2. Discussion of the Prior Art

"Laptop" and "Notebook" portable personal computers have reduced size and weight and are conveniently carried and used while traveling. Manufacturers of portable personal computers strive to provide the smallest, lightest computer possible. Unfortunately, it is difficult to manufacture a small, light, portable computer rugged enough to withstand being dropped or otherwise subjected to shock loading. The small size of today's portable computers leaves little or no internal room for shock absorbing materials to protect the vulnerable operating parts of the computer such as the LCD screen, the hard drive, the mother board, the various electrical connectors or the plastic outer case.

The effect of being dropped or hit is measured in terms of acceleration as compared to the earth's gravitational pull; one "G" represents an acceleration (or deceleration) of thirty two feet/sec$^2$. Each computer manufacturer's design is different, and so there is no universally safe level of shock for portable computers. Manufacturers of hard drives typically specify that drives can withstand shocks in the range of seventy five to two hundred Gs. Manufacturers of LCD screens, on the other hand, guarantee their screens to withstand shocks of only as much as fifty Gs, a level reached by dropping a portable computer from a height of only six to seven inches. Since carrying cases for portable computers are usually hand held or hung from shoulder straps more than six inches from the ground, it is important that the cases provide adequate protection from the falls and bumps typically encountered in every day travel and use.

Many manufacturers of carrying cases for portable computers incorporate foam padding into their cases, the padding typically ranges in thickness from one half to about three inches. Foam padding will protect a computer, unless the padding is compressed completely (i.e., compressed to half the thickness of the foam pad). Thus, three inches of padding will protect the computer through a deceleration distance of one and one half inches. Tests have shown that in carrying cases provided with two inches of foam padding, the fifty G threshold (for LCD screens) is exceeded in drops from as little as eight inches in height.

A carrying case offering superior protection against shocks is disclosed in U.S. Pat. No. 5,217,119 and is marketed by PORT Computer Cases of South Norwalk, Conn. The case disclosed in U.S. Pat. No. 5,217,119 includes a suspension system using an elastic sling. The computer is protected within the sling through the full distance of the decelerating fall, without resting on a foam barrier. The empty space below the sling, to the bottom of the case, provides twice as much protection as an equivalent amount of foam rubber padding. U.S. Pat. No. 5,524,754, assigned to PORT, Inc., discloses a carrying case for a notebook computer having a suspension system elastically supporting and protecting the computer during transport and allowing the computer to be used without removal from the case. The disclosures of U.S. Pat. Nos. 5,217,119 and 5,524,754 are incorporated herein by reference, in their entireties.

While the carrying case structures of the '119 and '754 patents provide a high level of protection against shocks, it is desired to produce a computer carrying case exhibiting the same high level of protection from shocks while also allowing the user to adapt the computer support structure to accommodate a portable computer or other instruments of varying sizes, and allowing more economical manufacture.

OBJECTS AND SUMMARY OF THE INVENTION

Accordingly, it is a primary object of the present invention to support a portable computer (or other delicate instrument) of virtually any size or shape in a carrying case having a system of adjustable impact resistant cushions.

It is another object of the present invention to provide a luggage insert including a system of adjustable cushions specially adapted to conform to the shape of a portable computer.

It is yet another object of the present invention to provide a carrying case having an adjustable cushion system releasably fastened into the carrying case interior and positionable by the user, to accommodate computers having irregular sizes or shapes.

Yet another object of the present invention is to provide adjustable, impact resistant cushions using a reduced quantity of cushion material and permitting relatively easy and economical manufacture.

Another object of the present invention is to protect delicate instruments with one or more adjustable, impact resistant cushions having improved dynamic resistance to shock loading.

The aforesaid objects are achieved individually and in combination, and it is not intended that the present invention be construed as requiring two or more of the objects to be combined unless expressly required by the claims attached hereto.

In accordance with the present invention, an adjustable, impact resistant cushion for use in a carrying case or the like has a first pad including a compressible, substantially rectangular foam piece, formed of one or more foam blocks, covered with a pliable non-porous cover. The cover contiguously envelops the foam piece and includes an air flow controlling vent. Air escapes from the enveloped foam piece at a controlled rate through the vent when the foam material is compressed, and so the pad absorbs shock by providing velocity-dependent resistance to compression, wherein compression resistance force increases with increasing compression velocity, in the same manner as a shock absorber or dashpot. Preferably, the compressible foam piece is open cell urethane foam.

The adjustable impact resistant cushion also includes a second pad having a substantially rectangular compressible foam piece, preferably of a greater thickness than the first pad foam piece, and a pliable non-porous cover contiguously enveloping the foam piece. The second pad also includes an air flow controlling vent for controlling the escape of air to absorb shock and provide velocity dependant resistance to compression.

The first and second pads of the adjustable cushion are hingedly connected to one another by a flexible hinge segment of webbing or plastic, and the adjustable cushion includes, on a back surface, one or more releasable hook and loop type fastener elements.

In another embodiment of the adjustable impact resistant cushion of the present invention, the cushion has a substantially planar backing having a first elongate leg or resilient support member hingedly connected to a second elongate leg or support member. The first leg is connected at a distal end to the end of the first pad and hingedly connected at a second end opposing the distal end to the second leg connected at a distal end to the opposite end of the second pad, thereby forming a folded parallelogram of cooperatively hinged elongate pads and hinged elongate support members attached only at the distal ends. In the second embodiment of the cushion of the present invention, releasable hook and loop fastener elements are carried by the first and second legs of the planar backing.

Preferably, two adjustable, impact resistant cushions are used in a luggage insert (for insertion into a carrying case or other luggage) or are incorporated directly into the interior portion of a carrying case having a compartment with an interior surface covered with felt or loop material for attachment using complementary hook fastener arrays carried by the adjustable cushions or vice versa. An adjustable cushion may also carry one or more flexible tabs bearing hook fastener arrays and extending perpendicularly or outwardly from the cushion pad major axis. The cushions are readily positioned in cushion pairs at selected separations and angular orientations, thereby accommodating portable computers having different widths and shapes.

A luggage insert in accordance with the present invention provides impact resistant support for a portable computer or other delicate instrument and includes a container or receptacle portion having a compartment interior surface with loop fastener elements, felt, or another surface adapted to receive and hold the cushion hook fastener elements. Preferably, the insert is shaped substantially as a six-sided box having a front wall opposing a back wall and adjacent a top wall opposing a bottom wall which is also adjacent a left side wall opposing a right side wall. In the simplest embodiment, one pair of opposing walls (on the container interior or compartment) carry fastener elements (e.g., loops) for receiving complementary fastener elements (e.g., hooks) on the adjustable impact-resistant cushions. Each impact resistant cushion preferably includes a hinge segment and is placed with a first pad on a compartment side wall, for example, and a second pad on the bottom wall of the compartment and positioned substantially at a right angle to the first pad. The second impact resistant cushion is placed with a first pad on the compartment side wall opposing the side wall having the first impact resistant cushion first pad and has the second pad positioned substantially at a right angle thereto, on the bottom wall, substantially in line with the second pad of the first impact resistant cushion. The compartment has a lineal dimension (e.g., along the bottom wall) greater than the combined dimensions of the second pads of the first and second cushions. Using the fasteners on the flexible tabs carried by, preferably, at least one of the adjustable impact resistant cushions, it is possible to adjustably position the cushion with a first pad spaced apart from the side wall of the compartment while the second pad rests on the bottom wall, thereby accommodating a portable computer having a narrower outer case or housing. The carrying case receives and supports the user-adjustable cushions in a plurality of positions or angular orientations, thereby accommodating irregularly shaped delicate instruments or computers.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENT

Figure 1:
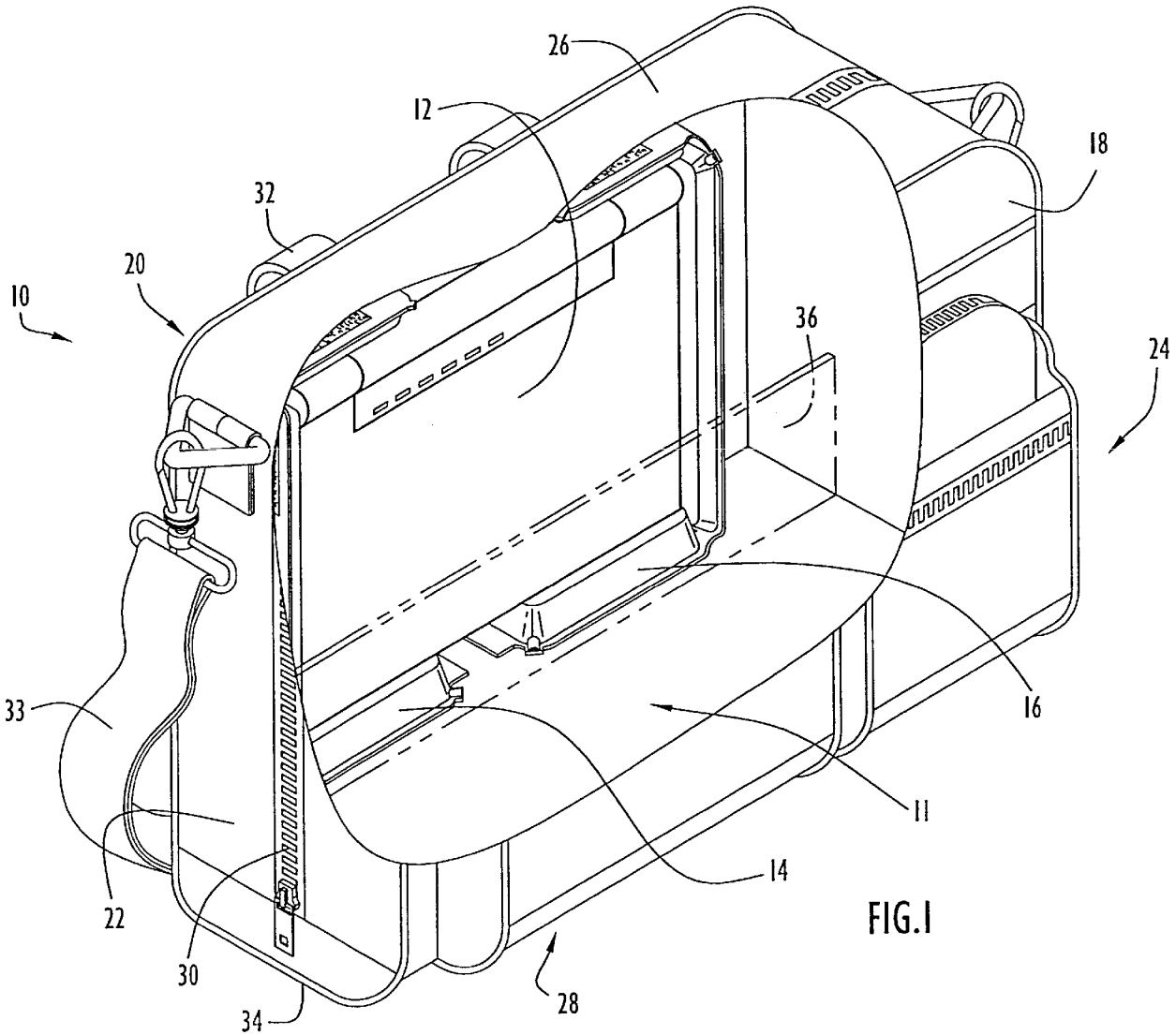
FIG. 1 is a cut-away view, in perspective, of a carrying case in accordance with the present invention, illustrating the user-positionable, impact resistant, adjustable cushions supporting a portable computer.
Figure 3:
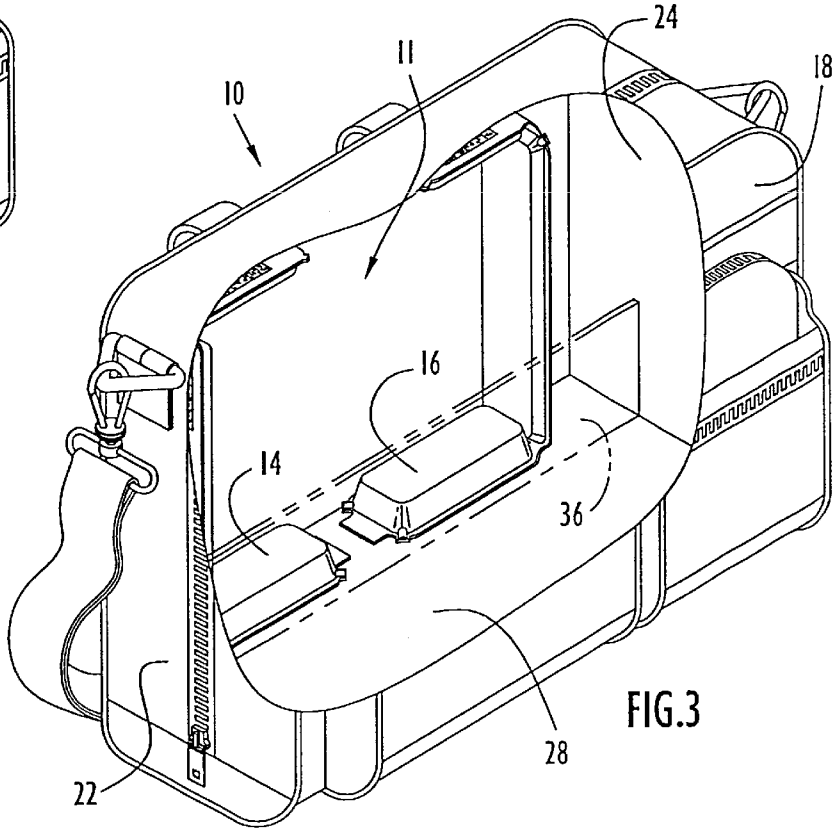
FIG. 3 is a cut-away view, in perspective, of the carrying case of FIG. 2, showing the adjustable cushions of the present invention positioned close to one another.
Figure 2:
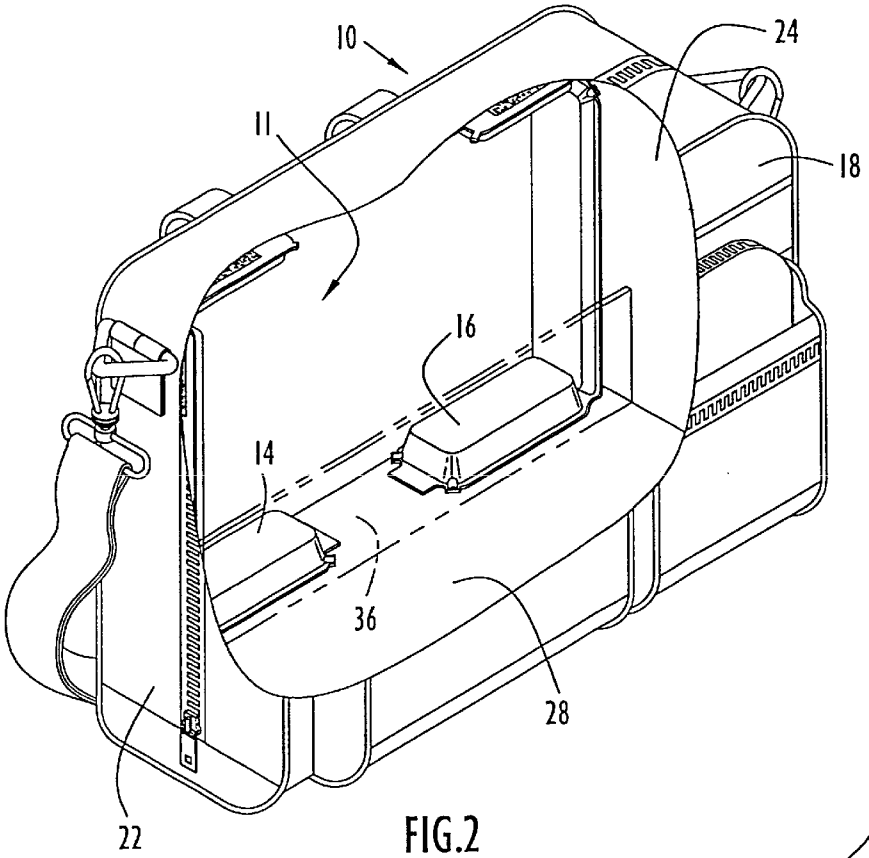
FIG. 2 is a cut-away view, in perspective, of a carrying case in accordance with the present invention showing the adjustable cushions positioned against the carrying case sidewalls, at the maximum separation.

Referring specifically to FIGS. 1, 2 and 3, a carrying case 10 enclosing an inner compartment 11 is adapted to support a portable computer 12 or other delicate instrument within first adjustably positionable impact resistant cushion 14 and second adjustably positionable impact resistant cushion 16.

Carrying case 10, according to the present invention, includes a box shaped exterior with a front wall 18 opposing a back wall 20 and adjacent left and right opposing side walls 22 and 24, and top and bottom side walls 26 and 28. Top, bottom, left and right side walls 22, 24, 26 and 28 extend between front wall 18 and back wall to form a generally rectangular, enclosed box-like frame with a zippered opening 30 substantially intermediate front and back edges of the left wall 22, right wall 24 and top wall 26 to selectively close or open case 10 and allow access to interior compartment 11. In the closed condition shown in FIG. 1, front wall 18, back wall 20, left and right side walls 22, 24, and top and bottom side walls 26, 28 cooperate to define the boundaries of an enclosed compartment 11 which is adapted for receiving a laptop, notebook or sub-notebook sized portable computer 12 or other delicate instrument or object for transportation or storage. Preferably, at least one handle 32 is attached to front wall 18, back wall 20 or top wall 26 forming an elevated loop for grasping with one hand to transport or maneuver case 10. Optionally, a shoulder strap 33 can be detachably attached, preferably on rings affixed to the side walls, 22, 24, forming a second larger elevated loop for transporting case 10. Bottom side wall 28 includes a flexible region or hinge 34 to allow pivoting of front wall 18 away from back wall 20 when zippered opening 30 is divided and case 10 is spread in an opened condition, thereby allowing access to compartment 11. An elongate substantially planar partition 36 (shown in hidden lines) within compartment 11 provides a stabilizing lateral support or boundary and extends from left side wall 22 to right side wall 24; partition 36 preferably is detachably fastenable to the side and bottom walls with flexible tabs bearing hook fasteners or the like (not shown). Front and back walls 18, 20, left and right side walls 22, 24 and top and bottom side walls 26, 28 can have any desired configuration for defining boundaries of compartment 11 in a suitable size for holding portable computer 12 or the like and form a carrying case of the type commonly referred to as an attache or portfolio. Carrying case 10 is preferably fabricated of leather, fabric or a synthetic fabric such as ballistic nylon and may include padded stiffening panels encased by the fabric material forming the outer covering. In the carrying case shown in FIGS. 1–3, hinge 34 is also integrally formed of the covering material.

In accordance with the present invention, an adjustable support system comprises first user positionable, adjustable, impact resistant cushion 14 and second user positionable, adjustable, impact resistant cushion 16. First cushion 14 and second cushion 16 are releasably fastened to an interior surface of compartment 11 to define a perimeter of cushion supporting elements easily repositionable around portable computer 12, by the user, through releasably attaching hook and loop fasteners or the like. FIG. 2 is a cut-away view, in perspective, of carrying case 10 showing first and second adjustable three segment cushions 14, 16 coupled to bottom wall 28 and positioned apart, with first three segment cushion 14 positioned against and coupled to the inside surface of left side wall 22 and second three segment cushion 16 positioned against and coupled to the inside surface of right side wall 24. FIG. 3 is a cut-away view, in perspective, of carrying case 10 showing the adjustable, three segment cushions 14, 16 positioned close to one another, with first cushion 14 positioned against and coupled to the inside surface of left side wall 22 and second cushion 16 spaced apart from the inside surface of right side wall 24 and closer to first cushion 14, with both cushions 14, 16 coupled to bottom wall 28. The interior compartment 11 of case 10 includes fastener elements such as Velcro™ style loops, or felt surfaces, for coupling with Velcro™ style hooks carried on the adjustable cushions 14, 16. It is to be understood that nearly any kind of releasable cooperative fastener elements could be employed in releasably fastening the adjustable cushions 14, 16 within the compartment 11. For example, the cushions 14, 16 could carry any of a variety of fastening elements such as buttons for engaging any of several button holes in the compartment; the cushions 14, 16 could carry snaps for engaging any of several cooperating snap receiving elements in the compartment, or the cushions 14,16 could carry screws for engaging any of several threaded holes in the compartment 11.

Figure 6:
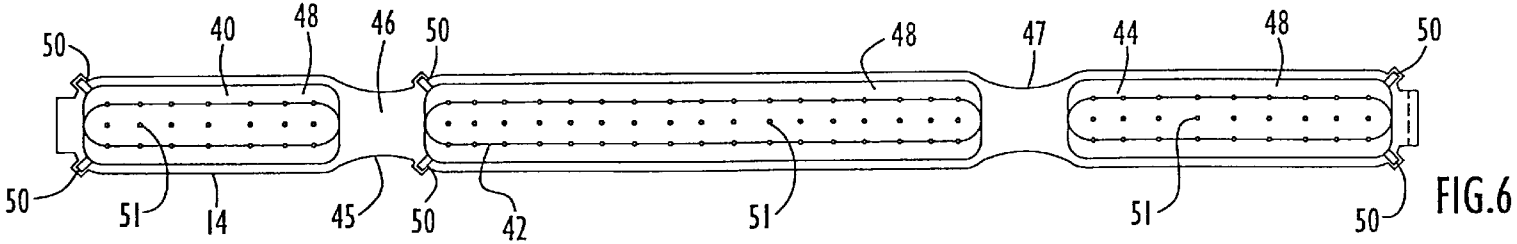
FIG. 6 is a top view of the cushion of FIG. 5.
Figure 5:
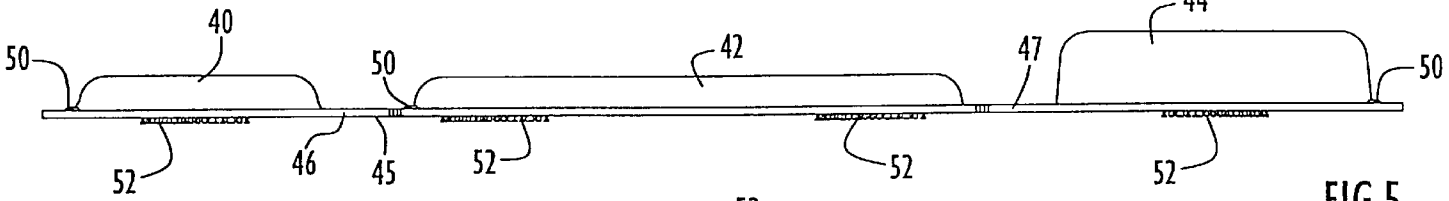
FIG. 5 is a side view of the cushion of FIG. 4 positioned in the linear orientation.
Figure 4:
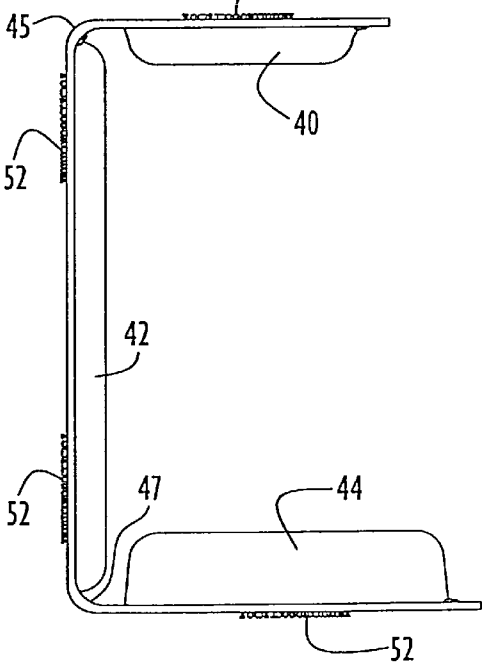
FIG. 4 is a side view of the impact resistant adjustable cushion of the present invention including three pad segments, oriented in a "C" shape.

Turning now to FIGS. 4, 5 and 6, there is illustrated a three segment, user positionable, adjustable impact resistant cushion (e.g., 14) including a first pad 40, a second pad 42 and a third pad 44, each mounted upon a flexible substrate 46 fabricated from a pliable non-porous plastic and hingedly connecting pads 40, 42 and 44 together at a first hinge 45 and a second hinge 47. Each pad 40, 42, 44 includes a substantially box-shaped foam piece preferably made from open-cell urethane foam and is enclosed within a pliable non-porous plastic cover 48 which envelops and contiguously covers the foam piece. Each of the pads 40, 42, 44 includes first and second nozzles or vents 50 (as best seen in FIG. 6) providing a conduit in fluid communication with the atmosphere and permitting controlled escape of air from the foam material of each pad when the pad is compressed.

In each pad made in accordance with the present invention, non-porous cover 48 is breached only through vent 50 which restricts the flow of air into and out of the open cell foam piece within. Thus, each pad acts like a shock absorber or dashpot and the force required to compress the pad is a function of the speed of compression.

As shown in FIGS. 5 and 6, first, second and third pads 40, 42, 44 have the same width of approximately one and one half inches. Third pad 44 has a thickness of one and one half inches while second and third pads 40, 42 each have a thickness of three quarters of an inch. The length of first pad 40 is three and one quarter inches; the length of second pad 42 is ten and one half inches, and the length of third pad 44 is four and three quarter inches. As seen in FIG. 6, the top surface of each pad 40, 42, 44 is stippled with a periodic two-dimensional array of frictionally engaging surface features or dimples 51.

Flexible substrate 46 carries four fastener elements in the form of patches of hooks 52 for engagement with the interior of compartment 11. Preferably, at least one fastener element 52 is disposed on either side of each hinge 45, 47. FIG. 4 is a side view of the impact resistant adjustable cushion (e.g. 14), in which the three pads 40, 42, 44 are oriented in a "C" shape; the hinges 45, 47 are bent at an angle of approximately ninety degrees from the straightened orientation of FIG. 5; bend angles of greater than ninety degrees are possible.

Figures 7, 8:
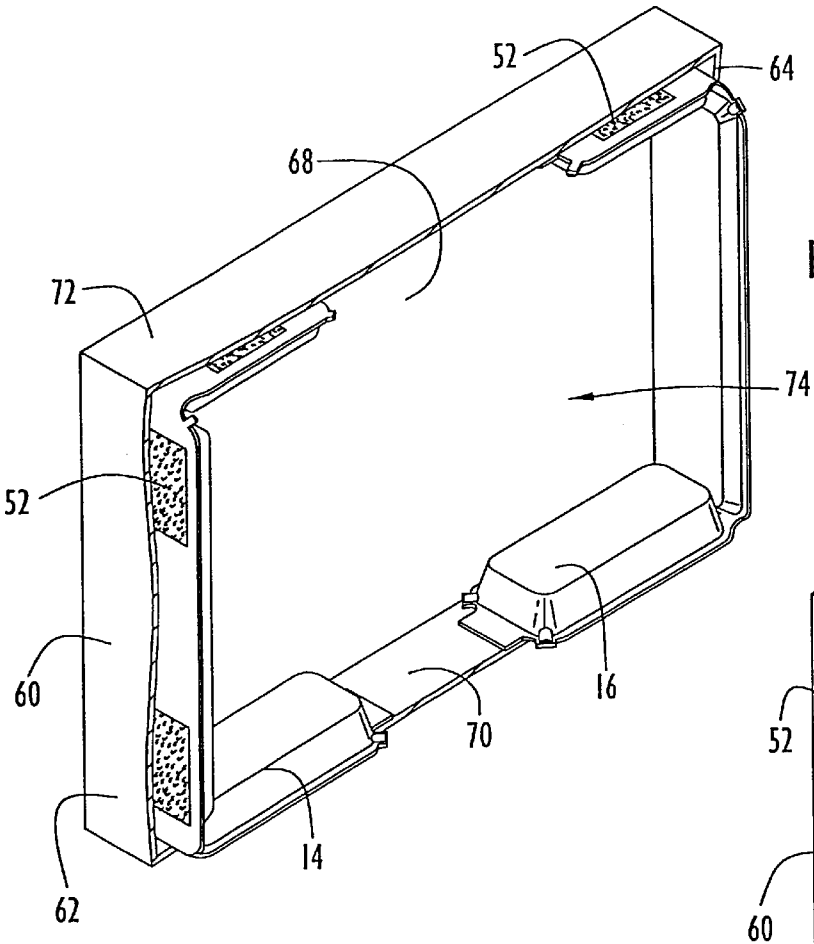
FIG. 7 is a cut-away view, in perspective, of a luggage insert or receptacle illustrating the segmented cushions of FIG. 4, in a spaced apart orientation.
FIG. 8 is a cut-away view, in perspective, of the adjustable cushions of FIG. 4 in a luggage insert or receptacle, showing the cushions spaced closely together.

FIG. 7 is a cut-away view, in perspective, of a luggage insert or receptacle 60 illustrating the position of the segmented cushions 14, 16 in a spaced apart orientation. Luggage insert 60 preferably includes a left side wall 62 opposing a right side wall 64 and proximate to a front wall 66 (not shown) opposite a back wall 68 and a top side wall 72 opposite a bottom side wall 70. Front and back walls 66, 68, left and right side walls 62, 64 and bottom and top side walls 70, 72 can have any desired configuration for defining boundaries of an enclosed compartment 74 in a suitable size for holding a portable computer or the like and, as thus far described, form an insert or receptacle to be inserted within a carrying case or luggage. Luggage insert 60 is fabricated of leather, fabric or a synthetic fabric such as ballistic nylon and typically includes one or more padded stiffening panels encased by the fabric material forming the outer covering. An adjustable support system comprises first adjustable impact resistant cushion 14 and second adjustable impact resistant cushion 16 fastened to an interior surface of compartment 74 to define a perimeter of cushion supporting elements easily repositionable around a portable computer or other instrument, by the user, through releasably attaching hook and loop fasteners or the like. FIG. 7 shows the adjustable cushions 14, 16 positioned apart with first cushion 14 positioned against the inside surface of left side wall 62 and second cushion 16 positioned against the inside surface of right side wall 26. FIG. 8 is a cut-away view, in perspective, of luggage insert 60 showing the adjustable cushions 14, 16 positioned close to one another, with first cushion 14 positioned against the inside surface of left side wall 62 and second cushion 16 spaced apart from the inside surface of right side wall 64 and closer to first cushion 14. The interior compartment 74 of luggage insert 60 is accessible through a hinged side wall with a releasable clasp closure or the like (not shown) and, within compartment 74, includes a fastener element such as Velcro™ style loops, or a felt surface, for coupling with Velcro™ style hooks carried on the adjustable cushions 14, 16. It is to be understood that nearly any kind of releasable cooperative fastener element could be employed in releasably fastening the adjustable cushions 14, 16 within the compartment 74. Luggage insert or receptacle 60 could be integrally made as part of a carrying case, could be formed as a pouch or have one or more carrying handles, a shoulder strap, or the like.

Figure 9:
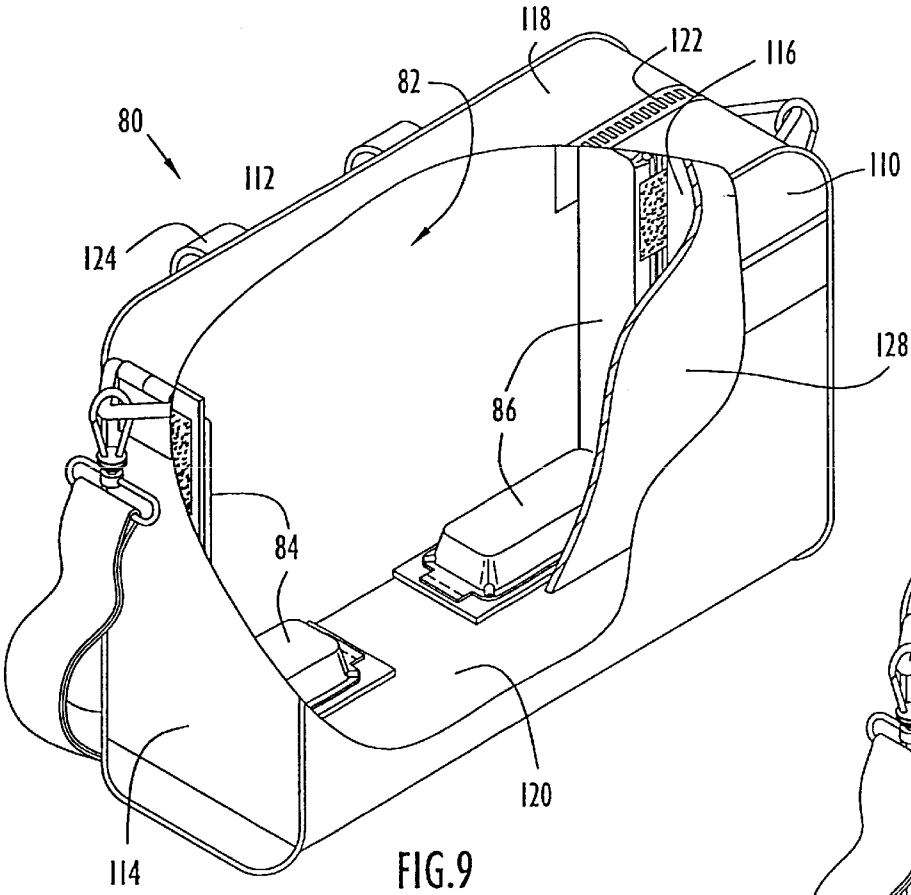
FIG. 9 is a cut-away view, in perspective, of a second embodiment of the carrying case of the present invention, showing spaced apart positioning of the adjustable cushions.

FIG. 9 is a cut-away view, in perspective, of a second embodiment of the carrying case 80 having an interior compartment 82, showing spaced apart positioning of a second embodiment of the user positionable, adjustable, impact resistant cushions 84, 86. Carrying case 80, according to the present invention, includes a front wall 110 opposing a back wall 112, left and right opposing side walls 114 and 116, and top and bottom side walls 118 and 120. The top, bottom, left and right side walls extend between front wall 110 and back wall 112 to form a generally rectangular frame with a zippered opening 122 substantially intermediate front and back edges of the left, right and top side walls to selectively close or open case 80 and allow access to interior compartment 82. In the closed condition shown in FIG. 9, front wall 110, back wall 112, left and right side walls 114, 116, and top and bottom side walls 118, 120 cooperate to define the boundaries of an enclosed compartment 82 which is adapted for receiving a laptop, notebook or sub-notebook sized portable computer (e.g., 12, not shown) or other delicate instrument or object, for transportation or storage. Preferably, at least one handle 124 is attached to front wall 110, back wall 112 or top side wall 118 forming an elevated loop for grasping with one hand to transport case 80, and an elongate, flexible webbing shoulder strap 126 is optionally detachably attachable, for ease of carry. An elongate substantially planar partition 128 (shown partially cut away) within compartment 82 is used to provide a stabilizing lateral support or boundary and extends from left side wall 114 to right side wall 116, and optionally from top 118 to bottom 120. Front and back walls 110, 112, left and right side walls 114, 116 and top and bottom side walls 118, 120 can have any desired configuration for defining boundaries of compartment 82 in a suitable size for holding a portable computer or the like and, as thus far described, form a carrying case of the type commonly referred to as an attache or portfolio. Carrying case 80 is preferably fabricated of leather, fabric or a synthetic fabric such as polyester or ballistic nylon and includes padded stiffening panels encased by the fabric material forming the outer covering.

Figure 10:
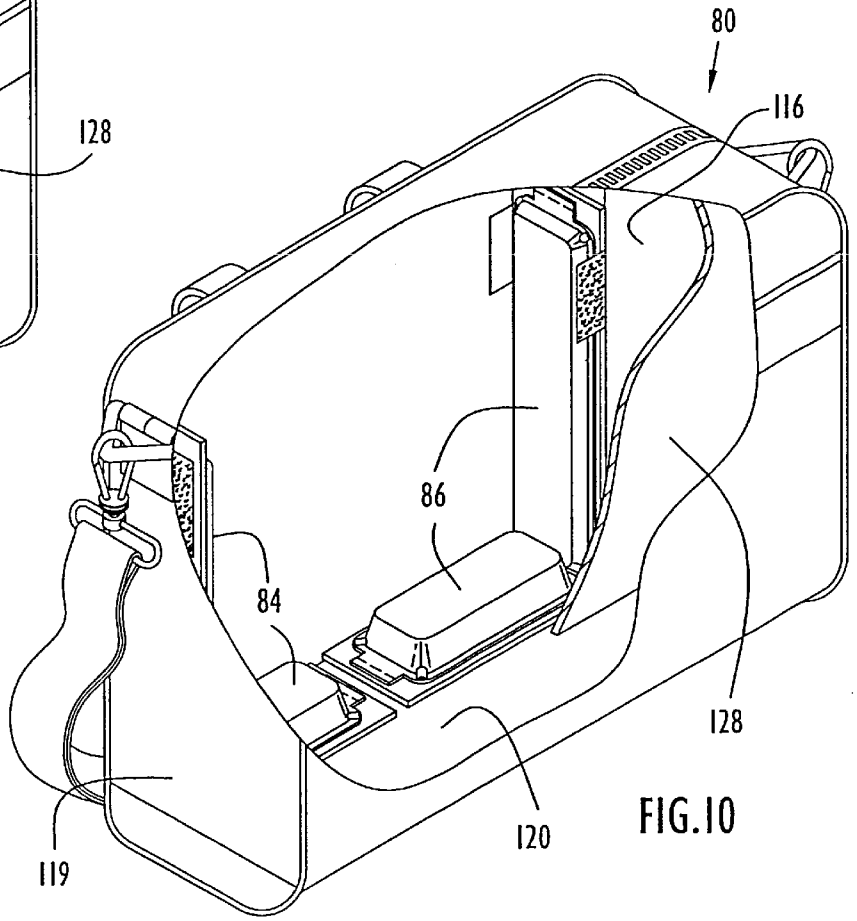
FIG. 10 is a cut-away view, in perspective, of the carrying case of FIG. 9 showing the cushions positioned closely together.

An adjustable support system in accordance with the present invention comprises a first user positionable, adjustable, impact resistant, two segment cushion 84 and a second user positionable, adjustable, impact resistant, two segment cushion 86 fastened to an interior surface of compartment 82 to define a perimeter of supporting elements easily repositionable around a portable computer or other instrument, by the user, through releasably attaching hook and loop fasteners or the like. FIG. 9 is a cut-away view, in perspective, of carrying case 80 showing the adjustable cushions 84, 86 positioned apart with first cushion 84 positioned against the inside surface of left side wall 114 and second cushion 86 positioned against the inside surface of right side wall 116. FIG. 10 is a cut-away view, in perspective, of carrying case 80 showing the adjustable cushions 84, 86 positioned close to one another, with first cushion 84 positioned against the inside surface of left side wall 114 and second cushion 86 positioned spaced apart from the inside surface of right side wall 116 and closer to first cushion 84. The interior compartment 82 of case 80 includes at least one fastener element such as a patch bearing an array of Velcro™ style loops, or a felt surface, for coupling with Velcro™ style hooks carried on the adjustable cushions 84, 86. It is to be understood that nearly any kind of releasable cooperative fastener element could be employed in releasably fastening the adjustable cushions 84, 86 within the compartment 82.

Figure 14:
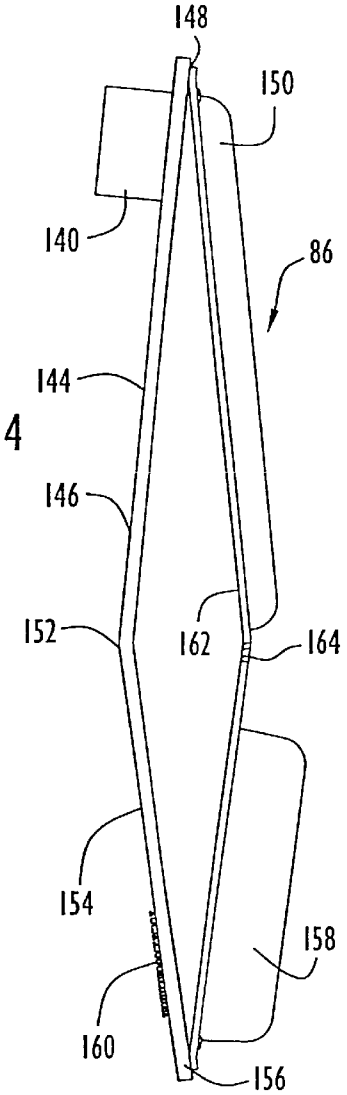
FIG. 14 is a side view of the adjustable cushion of FIG. 12, with the backing member spaced apart from the first and second pads.
Figure 13:
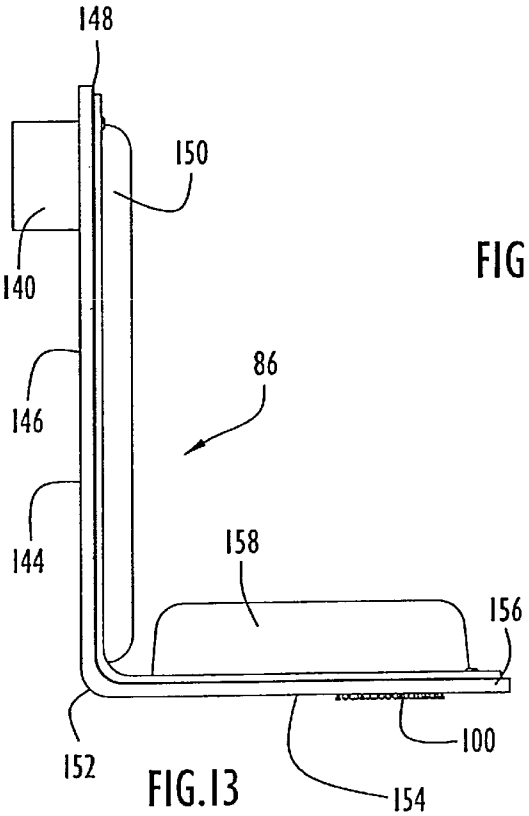
FIG. 13 is a side view of the adjustable cushion of FIG. 12 arranged in an L-shape.
Figure 12:
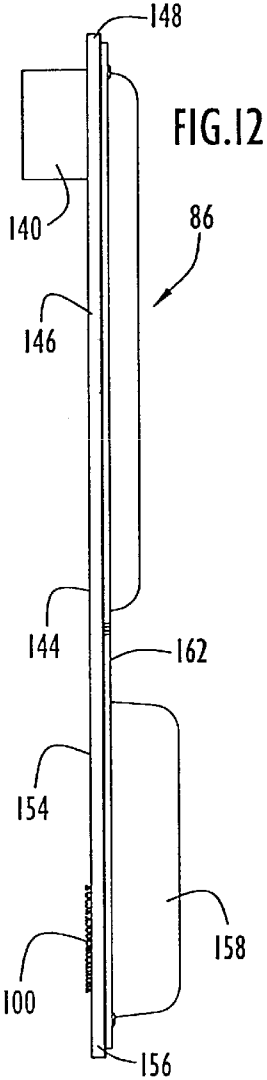
FIG. 12 is a side view of the adjustable cushion of FIG. 11.
Figure 11:
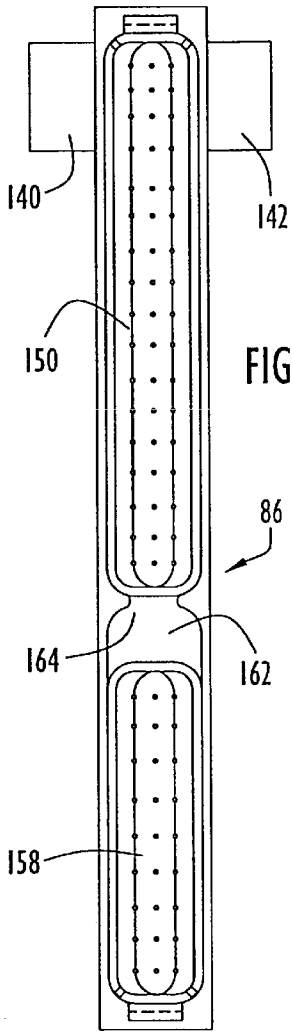
FIG. 11 is a top view of an adjustable cushion with outwardly extended fastener tabs.

FIG. 11 is a top view of an adjustable, user positionable, impact resistant, two segment cushion (e.g., 86) with first and second opposing flexible outwardly extended fastener tabs 140, 142. Adjustable impact resistant cushion 86 has a substantially planar backing 144 (as shown in FIGS. 12, 13 and 14) having a first leg or resilient support member 146 connected at a distal end 148 to the end of a first pad 150 and hingedly connected at a proximal end in hinge 152 to a proximal end of a second leg or support member 154 which is connected at its distal end 156 to the opposite end of a second pad 158, thereby forming two hinged pieces attached only at the distal ends. Backing 146 preferably includes a substantially planar, resilient, flexible, plastic core wrapped in a sewn-on felt covering, and backing hinge 152 is a weakened region perforated by stitching running through the felt covering. In this embodiment of the adjustable, impact absorbing cushion 86, a releasable hook and loop fastener element 160 (e.g., a patch bearing an array of hooks) is carried on the back of the second leg 154. As noted above, cushion 86 also carries first and second fastener tabs 140, 142 upon first support leg 146. Adjustable impact resistant cushion 86 includes first pad 150 and a second pad 158, each mounted upon a flexible substrate 162 fabricated from a pliable non-porous plastic and hingedly connecting the pads together at a second hinge 164. Backing hinge 152 and second hinge 164 are aligned to bend cooperatively together when the entire cushion 86 is flexed to form an L-shape, as in FIG. 13. Each pad 150, 158 is enclosed within a pliable non-porous cover 166 which envelops and contiguously covers pad foam pieces preferably made from open-cell urethane foam. Each of the pads 150, 158 includes first and second nozzles or vents 168 providing a conduit permitting controlled escape of air from the foam material of each pad when the pad is compressed. In each pad 150, 158, non-porous cover 166 is breached only through at least one vent 168 which restricts the flow of air into and out of the open cell foam piece within. Thus, as above, each pad acts like a shock absorber or dashpot and the force required to compress the pad is a function of the speed of compression.

As shown in FIGS. 11 and 12, first and second pads 150, 158 have the same width of approximately one and seven eighths inches. Second pad 158 has a thickness of one and one half inches while first pad 150 has a thickness of three quarters of an inch. The length of first pad 150 is eight and one half inches, and the length of second pad 158 is five inches. As seen in FIG. 11, the top surface of each pad 150, 158 is stippled with a periodic two-dimensional array of surface features or dimples 170. FIG. 14 is a side view of adjustable cushion 86, showing that the backing member 144 can be pulled away from the flexible substrate 162 bearing first and second pads 150, 158 to form a parallelogram.

Figure 18:
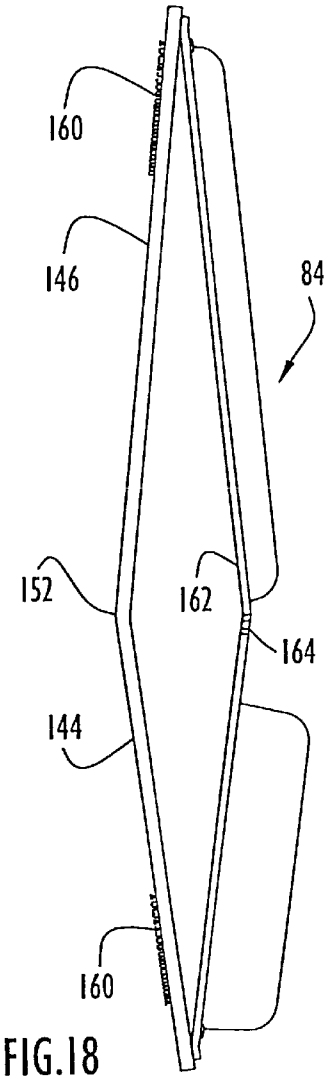
FIG. 18 is a side view of the adjustable cushion of FIG. 16, with the backing member spaced apart from the first and second pads.
Figure 17:
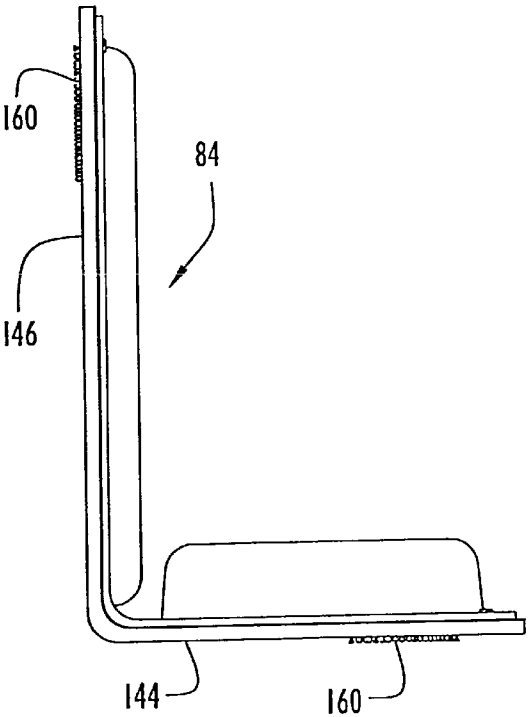
FIG. 17 is a side view of the adjustable cushion of FIG. 16 arranged in an L-shape.
Figure 16:
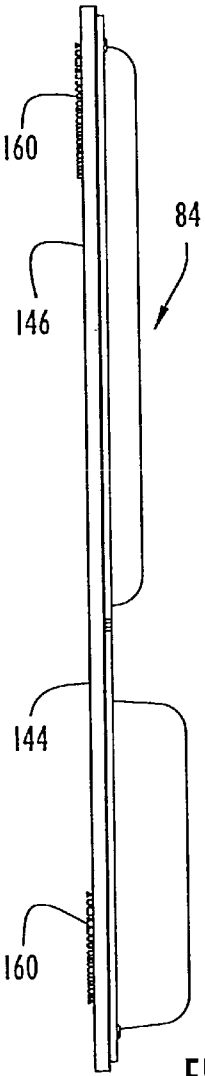
FIG. 16 is a side view of the adjustable cushion of FIG. 15.
Figure 15:
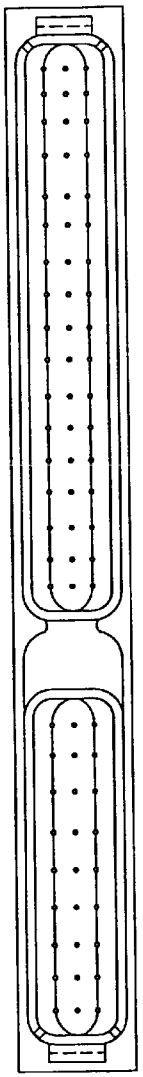
FIG. 15 is a top view of an adjustable cushion for use in conjunction with the adjustable cushion of FIG. 11.

FIG. 15 is a top view of user positionable, adjustable, impact resistant, two segment cushion 84 which is substantially identical to cushion 86 except for lacking the flexible fastener tabs 140,142 found on cushion 86. For purposes of nomenclature, cushion 86 (of FIGS. 11–14) shall be identified as the movable cushion and cushion 84 (of FIGS. 15–18) shall be identified as the fixed cushion. Fixed cushion 84 includes a patch bearing hook and loop fastener elements 160 on first leg 146 of backing 144 (instead of the tabs); in all other respects, fixed cushion 84 and movable cushion 86 are identical. FIG. 16 is a side view of the fixed cushion 84, and FIG. 17 is a side view of fixed cushion 84 arranged in an L-shape. FIG. 18 is a side view of fixed cushion 84, with the backing member 144 spaced apart from the flexible substrate 162 to form a parallellogram.

Figure 20:
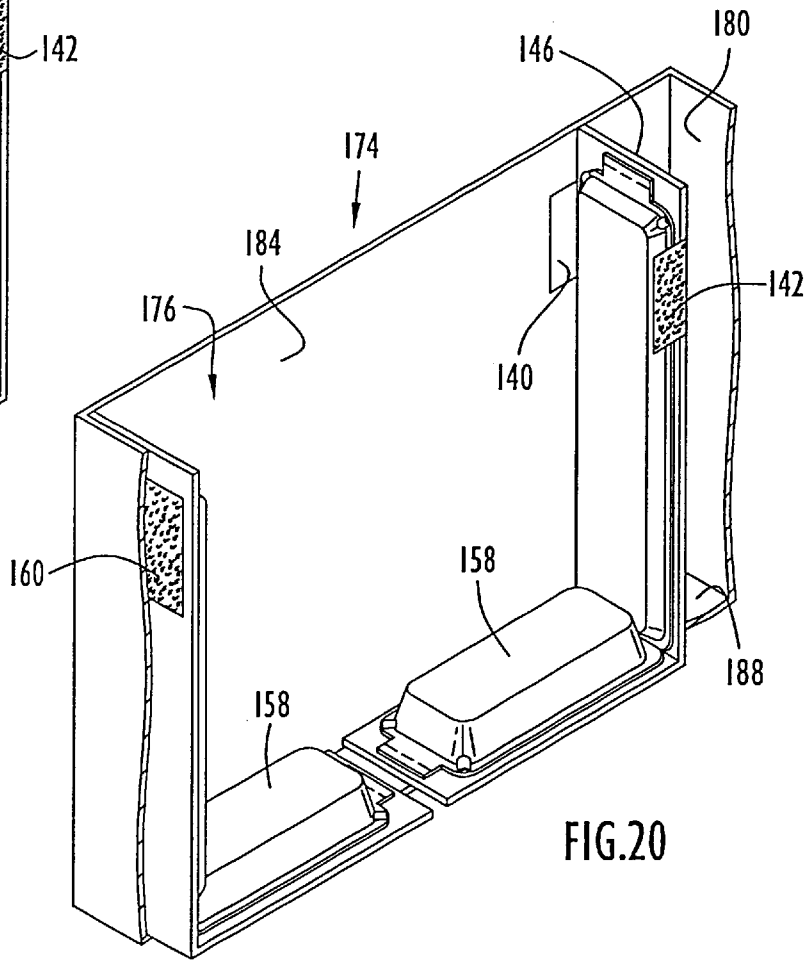
FIG. 20 is a cut-away perspective illustration of the luggage insert of FIG. 19 with the adjustable cushions positioned close together.
Figure 19:
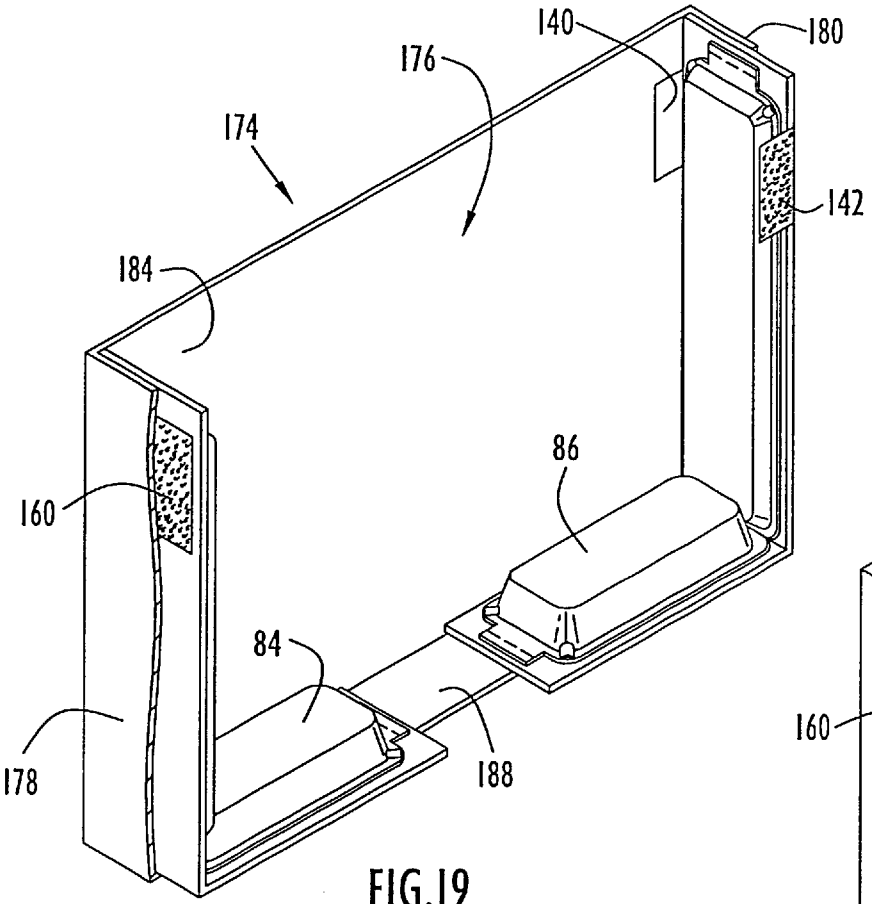
FIG. 19 is a cut-away perspective view of a luggage insert or receptacle in which are disposed first and second adjustable impact absorbing cushions in a spaced apart orientation.

Turning now to FIG. 19, a luggage insert or receptacle 174 adapted to be carried alone or within a carrying case has an interior compartment 176 in which are disposed a fixed two segment cushion 84 and a movable two segment cushion 86, in a spaced apart orientation. Luggage insert 174 preferably includes a left side wall 178 opposing a right side wall 180 and proximate to a front wall 182 (not shown), which is opposite a back wall 184 and, optionally, a top side wall 186 (not shown) opposite a bottom side wall 188. Front and back walls 182, 184, left and right side walls 178, 180 and top and bottom side walls 186, 188 can have any desired configuration for defining boundaries of a pocket or compartment 176 in a suitable size for holding a portable computer or the like and, as thus far described, form an insert or receptacle to be inserted within a carrying case or luggage. Luggage insert 174 is fabricated of leather, fabric or a synthetic fabric such as ballistic nylon and can include one or more padded stiffening panels encased by the fabric material forming the outer covering. An adjustable support system comprises fixed cushion 84 and moveable cushion 86 fastened to an interior surface of compartment 176 to define a three sided perimeter of supporting elements easily repositionable around a portable computer, by the user, through releasably attaching hook and loop fasteners or the like. FIG. 19 shows the adjustable cushions 84, 86 positioned apart with fixed cushion 84 positioned against the inside surface of left side wall 178 and moveable cushion 86 positioned against the inside surface of right side wall 180. Hook fastener elements 160 on the second pads 158 of both cushions 84, 86 are releasably coupled to bottom wall 188. First fastener tab 140 and second fastener tab 142 of moveable cushion 86 are coupled to back wall 184 and front wall 182 (not shown), respectively. FIG. 20 is a cut-away view, in perspective, of luggage insert 174 showing the adjustable cushions 84, 86 positioned close to one another, with fixed cushion 84 positioned against the inside surface of left side wall 178 and movable cushion 86 positioned with first leg 146 spaced apart from the inside surface of right side wall 180 and closer to fixed cushion 84. The position of first leg 146 of movable cushion 86 is supported by first fastener tab 140 and second fastener tab 142 which are coupled to back wall 184 and front wall 182 (not shown), respectively. The second pad segments 158 of both adjustable cushions 84, 86 are coupled to the interior surface of bottom wall 188, once the cushion fastener elements 160 are brought into contact therewith, thus placing the thicker pads upon the bottom wall, for greatest protection against shock from drops.

The interior compartment 176 of luggage insert 174 is accessible through the open top end as shown in FIGS. 19 and 20, or, if the optional top side wall 186 is present, a hinged side wall with a releasable clasp closure or the like (not shown) provides access. Compartment 176 includes one or more fastener elements such as Velcro™ style loops, or a felt surface, for coupling with Velcro™ style hooks carried on the adjustable cushions 84, 86. It is to be understood that nearly any kind of releasable cooperative fastener element could be employed in releasably fastening the adjustable cushions 84, 86 within the compartment 176. Luggage insert or receptacle 174 could be integrally made as part of a carrying case or could have one or more carrying handles, or the like.

Figure 23:
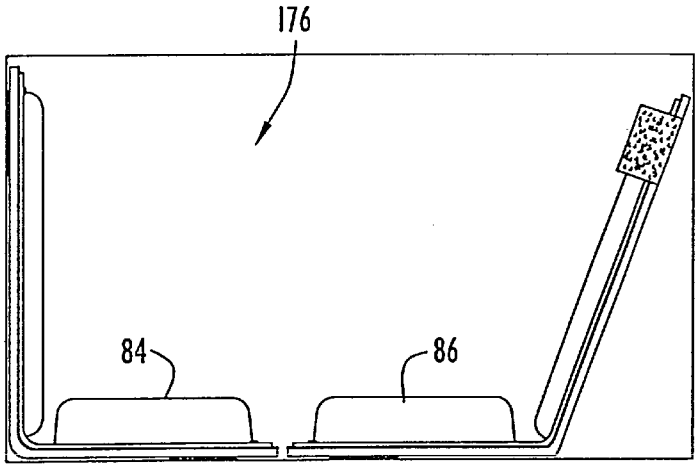
FIG. 23 is another side view of the luggage insert of FIG. 21 showing another angled orientation of the adjustable cushions of the present invention.
Figure 22:
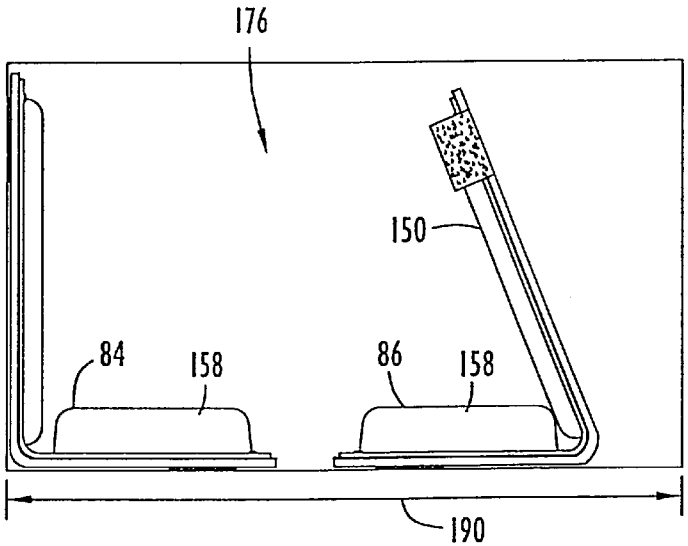
FIG. 22 is a side view of the luggage insert of FIG. 21 showing an angled orientation for the adjustable cushions of the present invention.
Figure 21:
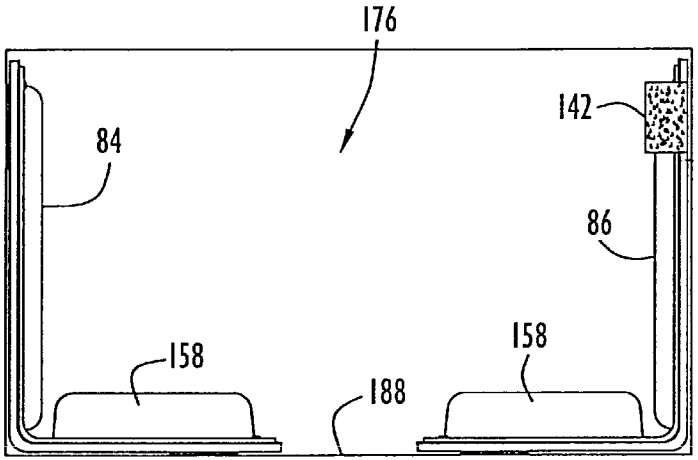
FIG. 21 is a side view of the compartment within the luggage insert of FIG. 19, showing a spaced apart and vertical orientation of the adjustable cushions.

FIG. 21 is a side view of compartment 176 within luggage insert 174, showing a spaced apart and vertical orientation of the adjustable cushions 84, 86, as in FIG. 19. Many angular orientations are possible when positioning movable cushion 86; FIG. 22 is a side view of compartment 176 showing an angled orientation for the movable adjustable cushion 86 in which the second pad 158 is laterally displaced (to be more closely spaced to the second pad 158 of fixed cushion 84) and first pad 150 of cushion 86 is disposed at an acute angle (with respect to second pad 158). FIG. 23 is a side view of compartment 176 showing another angled orientation for the movable adjustable cushion 86 in which the second pad 158 is laterally displaced (to be even more closely spaced to the second pad 158 of fixed cushion 84) and first pad 150 of cushion 86 is disposed at an obtuse angle (with respect to second pad segment 158). FIGS. 22 and 23 illustrate that the adjustable cushions 84, 86 can be positioned to provide a protective perimeter of impact resistance for instruments having a wide variety of shapes and sizes.

Alternatively, an adjustable support system comprises first and second opposing moveable cushions (e.g., 86)

fastened to the interior surfaces of a compartment (e.g., 176) to define a three sided perimeter of repositionable supporting elements readily repositioned by the user, through releasably attaching hook and loop fastener arrays 140, 142.

From the above, it will be appreciated that the carrying case and the user-positionable impact resistant cushions of the present invention can be used to provide a closely fitted perimeter of support to protect a portable computer during transport or storage. The carrying case or luggage insert compartment (e.g., 176) has a lineal dimension (e.g., 190, along the bottom wall 188 as shown in FIG. 22) greater than the combined dimensions of the pad segments (e.g., 158) of the first and second cushions when positioned upon and coupled with the compartment wall. The user may position the adjustable cushions in any manner to provide a perimeter of a wide range of widths or having irregular, non-parallel sides. As used herein, "portable" computer refers to any computing device reduced in size and weight as to be carried and employed while traveling, or any other delicate instrument which will fit within the compartment of the case. By "adjustable cushion" is meant a cushion which may include a flexible hinge or other flexible, bendable or changeable feature permitting the cushion to be converted to a selected shape. By "user positionable" is meant that the individual cushions can be removed, uncoupled or unfastened and replaced in a different position and/or angular orientation. The impact resistant cushions disclosed as examples above are adjustable, but a carrying case or luggage insert in accordance with the present invention need not include adjustable cushions; instead, user positionable cushions having a single pad can be releasably fastenable within the compartment; a plurality of such cushions can be fastened individually to define a protective perimeter for a portable computer, or the like. By "non-porous" is meant substantially impermeable to air, so that, during compression, the great majority of air is expelled from a pad through the vent. By "pliable" is meant deformable in response to force generated by a decelerating computing device or instrument stored or carried in the case or luggage insert. The vented pads disclosed in the examples given above include urethane foam pieces, but other shock absorbing and highly compressible materials which will readily expel air through the vents, upon compression, can be employed. Further, the cushions of the present invention can include a rigid and unhinged substrate or backing member carrying releasable fastening elements; substitute rigid cushions of a variety of sizes and shapes can be provided to the user so that rigid cushions to fit a user's particular portable computer can be selected and inserted into the carrying case compartment.

In as much as the present invention is subject to various modifications and changes in detail, the above description of a preferred embodiment is intended to be exemplary only and not limiting. It is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A luggage insert providing impact resistant support for a portable computer or other delicate instrument and adapted to be carried alone or within a carrying case, comprising:

a) a receptacle defined by a front wall, a back wall, a bottom side wall, a left side wall and a right side wall, said receptacle enclosing a compartment carrying a first fastener element; and b) an impact-resistant cushion adjustably releasably fastened in said compartment, including:

b1) a first pad extending along one of said left or right side walls and including a compressible foam piece and a pliable cover contiguously covering said foam piece, said first pad being spaced from the other of said left or right side walls to define a cavity between said first pad and said other of said left or right side wall for receiving a portable computer or other delicate instrument;

b2) a second pad extending partly along said bottom side wall and including a compressible foam piece, a pliable cover contiguously covering said foam piece and hingedly connected with said cover of said first pad; and b3) a second fastener element carried by said cushion and releasably coupling with said first fastener element in various selected positions to selectively adjust the spacing between said first pad and said other of said left or right side wall to correspondingly adjust the size of said cavity in accordance with the size of the portable computer or other delicate instrument to be received therein.

2. The luggage insert of claim 1, wherein said first fastener element is disposed on one of said front wall or said back wall and said second fastener element is carried by said first pad.

3. The luggage insert of claim 1, wherein said first fastener element is carried by said bottom side wall and said second fastener element is carried by said second pad.

4. The luggage insert of claim 2, wherein said second fastener element is a hook and loop fastener element including a flexible tab extending outwardly from said first pad; and wherein said first fastener element is formed by an interior surface of said one of said front wall or said back wall releasably attachable to said hook and loop fastener element.

5. The luggage insert of claim 3, wherein said first and second fastener elements are complementary hook and loop fastener elements, respectively.

6. The luggage insert of claim 1, wherein said second fastener element is capable of releasably coupling with said first fastener element in a first selected position with no space between said first pad and said one of said left or right side wall and a second selected position with a selected space maintained between said first pad and said one of said left or right side wall, said first selected position corresponding to a first size for said cavity and said second selected position corresponding to a second size for said cavity smaller than said first size.

7. The luggage insert of claim 1, wherein said second fastener element is capable of releasably coupling with said first fastener element in said selected positions with said first pad disposed at a right angle to said second pad.

8. The luggage insert of claim 1, wherein said second fastener element is capable of releasably coupling with said first fastener element in said selected positions with said first pad disposed at an acute angle to said second pad.

9. The luggage insert of claim 1, wherein said second fastener element is capable of releasably coupling with said first fastener element in said selected positions with said first pad disposed at an obtuse angle to said second pad.

10. The luggage insert of claim 3 and further including a third fastener element carried by said first pad and releasably coupling with one of said front wall or said back wall.

11. The luggage insert of claim 10, wherein said third fastener element is releasably coupled with both of said front wall and said back wall.

12. The luggage insert of claim 10 wherein said third fastener element includes a hook and loop fastener element releasably coupling with an interior surface of said one of said front wall or said back wall.

13. The luggage insert of claim 2, wherein said foam piece of said first pad is mounted on a planar backing and said second fastener element includes a flexible tab capable of being bent perpendicular to said backing.

14. The luggage insert of claim 1, wherein said receptacle includes a top side wall and said cushion further includes a third pad extending along said top side wall and including a compressible foam piece and a pliable cover contiguously covering said foam piece and hingedly connected with said cover of said first pad.

15. A luggage insert providing impact resistant support for a portable computer or other delicate instrument and adapted to be carried alone or within a carrying case, comprising:

a receptacle defined by a front wall, a back wall, a bottom side wall, a left side wall and a right side wall, said receptacle enclosing a compartment;

a first impact-resistant cushion releasably fastened in said compartment and including a first pad and a second pad, said first pad extending along one of said left or right side walls and comprising a compressible foam piece and a pliable cover contiguously covering said foam piece, said second pad extending partly along said bottom side wall and comprising a compressible foam piece and a pliable cover contiguously covering said foam piece, said second pad being hingedly connected to said first pad;

a second impact-resistant cushion releasably fastened in said compartment and including a first pad and a second pad, said first pad of said second cushion extending along the other of said left or right side walls and comprising a compressible foam piece and a pliable cover contiguously covering said foam piece, said second pad of said second cushion extending partly along said bottom side wall and comprising a compressible foam piece and a pliable cover contiguously covering said foam piece, said second pad of said second cushion being hingedly connected to said first pad of said second cushion, said first pads being spaced from one another to define a cavity therebetween for receiving a portable computer or other delicate instrument;

a first fastener element carried by said receptacle and disposed within said compartment;

a second fastener element carried by said first cushion and releasably coupling with said first fastener element;

a third fastener element carried by said receptacle and disposed within said compartment; and a fourth fastener element carried by said second cushion and releasably coupling with said third fastener element in various selected positions to selectively adjust the spacing between said first pads to correspondingly adjust the size of said cavity in accordance with the size of the portable computer or other delicate instrument to be received therein.

16. The luggage insert of claim 15, wherein said fourth fastener element is capable of releasably coupling with said third fastener element to fasten said second cushion in said selected positions with said first pad of said second cushion disposed at a right angle to said second pad of said second cushion.

17. The luggage insert of claim 15, wherein said fourth fastener element is capable of releasably coupling with said third fastener element to fasten said second cushion in said selected positions with said first pad of said second cushion disposed at an acute angle to said second pad of said second cushion.

18. The luggage insert of claim 15, wherein said fourth fastener element is capable of releasably coupling with said third fastener element to fasten said second cushion in said selected positions with said first pad of said second cushion disposed at an obtuse angle to said second pad of said second cushion.

19. The luggage insert of claim 15, wherein said fourth fastener element is capable of releasably coupling with said third fastener element in a first selected position with no space between said first pad of said second cushion and said other of said left or right side wall and a second selected position with a selected space maintained between said first pad of said second cushion and said other of said left or right side wall, said first selected position corresponding to a first size for said cavity and said second selected position corresponding to a second size for said cavity smaller than said first size.

* * * * *